US009928812B2

(12) United States Patent
Porter et al.

(10) Patent No.: US 9,928,812 B2
(45) Date of Patent: Mar. 27, 2018

(54) CANTILEVERED GUITAR HAND PLACEMENT GUIDE AND SUPPORT BAR

(71) Applicant: Russell K. Porter

(72) Inventors: Russell K. Porter, San Mateo, CA (US); Jerrilyn J. Roblin-Porter, San Mateo, CA (US)

( * ) Notice: Subject to any disclaimer, the term of this patent is extended or adjusted under 35 U.S.C. 154(b) by 0 days.

(21) Appl. No.: 15/438,399

(22) Filed: Feb. 21, 2017

(65) Prior Publication Data

US 2018/0053492 A1 Feb. 22, 2018

Related U.S. Application Data

(63) Continuation-in-part of application No. 15/238,648, filed on Aug. 16, 2016, now Pat. No. 9,576,562.

(51) Int. Cl.
*G10D 3/18* (2006.01)

(52) U.S. Cl.
CPC ..... *G10D 3/18* (2013.01)

(58) Field of Classification Search
CPC ..... G10D 3/18
See application file for complete search history.

(56) References Cited

U.S. PATENT DOCUMENTS 7,812,233 B1 * 10/2010 Lee ..... G10D 3/08 84/317

* cited by examiner

*Primary Examiner* — Kimberly Lockett
(74) *Attorney, Agent, or Firm* — Ray K. Shahani, Esq.

(57) ABSTRACT

A guitar hand placement guide and support bar that fits between the strings of a guitar and the upper surface of the guitar and attaches to the upper surface of the body of a guitar with one or more suction cups. An upper cantilevered platform portion extends over the strings and supports the guitar player's hand while in use. The removable guitar hand placement guide and support bar can be consistently re-positioned adjacent where the strings are picked or strummed in precisely the same place. A dogleg extension and one or more internal finger grip portions located along the left side edge of the upper platform portion provide the guitar player with optional methods of use.

9 Claims, 15 Drawing Sheets

CANTILEVERED GUITAR HAND PLACEMENT GUIDE AND SUPPORT BAR

RELATED APPLICATIONS

This Application is a Continuation-In-Part application of U.S. patent application Ser. No. 15/238,648 filed Aug. 16, 2016, entitled "GUITAR HAND PLACEMENT GUIDE AND SUPPORT BAR", issued Feb. 21, 2017 as U.S. Pat. No. 9,576,562, which is incorporated herein by reference in its entirety, and claims any and all benefits to which it is entitled therefrom.

FIELD OF THE INVENTION

The present invention is a method and apparatus for guiding, positioning and supporting the pick and strum hand over the strings of a guitar.

BACKGROUND OF THE INVENTION

The guitar is a stringed musical instrument with a fretted fingerboard, typically incurved sides, and six or twelve strings, played by plucking or strumming with the fingers or a plectrum (pick). Guitars are generally either electric or acoustic. There are three main types of modern acoustic guitar: the classical guitar (nylon-string guitar), the steel-string acoustic guitar, and the archtop guitar. The acoustic guitar generally consists of a hollow body with incurved sides, a fretboard extending to one side with a head at the top. Strings are in tension above a series of individual frets located along the fretboard and extend from the head to the bridge.

The tone of an acoustic guitar is produced by the strings' vibration, amplified by the body of the guitar, which acts as a resonating chamber. The classical guitar is often played as a solo instrument using a comprehensive finger-picking technique. The term "finger-picking" can also refer to a specific tradition of folk, blues, bluegrass, and country guitar playing in the United States.

Electric guitars, introduced in the 1930s, use an amplifier that can electronically manipulate and shape the tone. Early amplified guitars employed a hollow body, but a solid body was eventually found more suitable, as it was less prone to feedback.

Generally, the strings of the guitar are plucked or strummed with the fingers of the right hand while the fingers of the left hand are placed in patterns on top of the frets to change the key of the string being played. A chord is played by placing the fingers of the left hand in a pattern on the frets while the strings are strummed with the fingers of the right hand. Alternatively, individual strings can be picked by the fingers of the right hand while the note is selected by placement of the fingers of the left hand over the appropriate fret or frets.

One of the problems that learners face is control of placement of the right hand and fingers during picking and strumming Often players will post or place the small finger or combination of ring finger and small finger on the pick guard near the sound hole to support or brace the right hand in a stable position while its fingers pick or strum the strings. This solution is less than satisfactory for the following reasons: First of all, there is no specific location to place the right-hand fingers of the player since the pick guard covers a fairly large area. Second, since the soundboard of the body is below the height of the strings stretched above the sound hole, the fingers must stretch to be placed on the pick guard leaving little clearance for the other fingers to strum or pick or use a plectrum as desired. For a student learning to play the guitar, this stretch is difficult. Most importantly, it is not possible to support or brace the palm of the right hand while playing a guitar since it would interfere with resonance of the strings. Thus, it would be advantageous to provide a pick and strum guide bar that would guide the fingers into a proper location, braced above the strings, with the ability to also support the palm of the right hand while playing.

U.S. Pat. No. 9,927,930 is a stringed instrument hand rest that is nothing more than a single loop of material that supports the hand from the outside. However, this device doesn't provide a deck for supporting the small finger or ring finger and small finger while picking or strumming. Furthermore, there is no portion that sits above the strings to support the hand from below and prevent interference of the hand with the strings.

U.S. Pat. No. D381356 is a guitar hand rest. However, there are no means for attaching the pedestal to the top of the body of the guitar. Also, there are no feet that provide an accurate, easy and precise way to position the hand rest above the strings. Finally, there is no gooseneck, opening, aperture or other structural means for accurately positioning and bracing the small finger or $4^{th}$ and $5^{th}$ fingers while picking or strumming the strings with the other 3 or 4 fingers.

Finally, U.S. Pat. Nos. 9,299,327 and 9,240,168 both teach a stringed musical instrument hand support apparatus. However, these devices use strings or cords with hooks at the ends to secure the hand support apparatus between the sound hole or other opening in the body of the musical instrument and the end of the guitar opposite the head and neck. There is no way to guarantee accurate, precise placement each time the device is used. Also, the hand rest has simple pedestals that rest on the top of the soundboard and can be positioned essentially anywhere above the strings without limitation, thus providing no guidance to the novice guitar player on how to position the hand rest.

SUMMARY OF INVENTION AND ADVANTAGES

The present invention is a unique apparatus for supporting the wrist and positioning of bracing fingers while picking and strumming a guitar.

The present invention has feet that attach securely yet temporarily to the top of the soundboard without compromise to the integrity of the soundboard. Leg ends that extend from one end fit in place adjacent the bridge centered over the strings.

Another embodiment of the present invention has a foot that extends through the sound hole with a groove extending along one end that fits securely over the soundboard along the periphery of the hole in the soundboard, thereby maintaining the pick and strum bar centered above the strings.

To make the invention suitable to guitars in which the upper surface of the soundboard of the body of the guitar is textured or otherwise not smooth and suitable for use with suction cups to hold the pick and strum bar to the guitar, the present invention is also an accessory that slides between the strings and the upper face of the soundboard at a position between the sound hole and the bridge of the guitar, with straps that fasten around the back of the guitar at a position roughly midpoint the incurved sides. The suction cups of the pick and strum bar can adhere securely to the accessory and thus hold the pick and strum bar in place centered above the strings.

An advantage of the present invention is that it permits the upper extremity to stabilize itself from the shoulder to the fingers. The arm can relax yet remain in a fixed position without muscular tension.

Another advantage of the present invention is that it provides optimal positioning for single string play or "picking". The arm in a comfortable and stable position the fingers may be used to reach the individual strings to sound a specific tone.

Another advantage of the present invention is that it provides a 1-2 finger station or home base position. The semi-circular cut-outs at the bottom of the platform permit 1-2 fingers to remain fixed to hold the hand in position for optimal play and use. The thumb, middle finger and index finger are free to extend and contract, and thereby contact the individual strings for specific play.

Another advantage of the present invention is that the smooth flat surface of the bar allows the thenar eminance to slide across the top and deliver exact placement of the thumb to get very consistent sounds from the strings. A very easy and repeatable sound is gained by the beginner which is encouraging for early players.

Another advantage of the present invention is that it provides optimal position in multi-string play or "strumming". The forearm and hand is best positioned to provide consistent strumming with either a pick or the thumb giving the best depth of pick or thumb "into the strings" the wrists platform allows the hand to "roll" up and down with a pick at a consistent depth into the strings.

Another advantage of the present invention is that it provides accurate finger and hand positioning. Using the two finger "cut-outs" and wrist platform to precisely place the fingers and hand/wrist in the exactly same place after hand play without the platform.

Another advantage of the present invention is that the "thenar eminence", or the fleshy round part of the palm below the thumb is allowed to brush against, slide and be supported by the platform. The thenar eminence serves as a guide for the upper thumb and its meeting with the various strings. There is the ability to finesse the end of the thumb to lightly hit just the high, mid or low sounding strings for an accurate strum of the chords.

Another advantage of the present invention is that the bar or platform portion will fit the majority of current popular, newer flat-top acoustic guitars. This would include guitars with about 3½" to 4" diameter sound holes, and either with pick-guards or any size or shape or without.

Benefits and features of the invention are made more apparent with the following detailed description of a presently preferred embodiment thereof in connection with the accompanying drawings, wherein like reference numerals are applied to like elements.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1A:
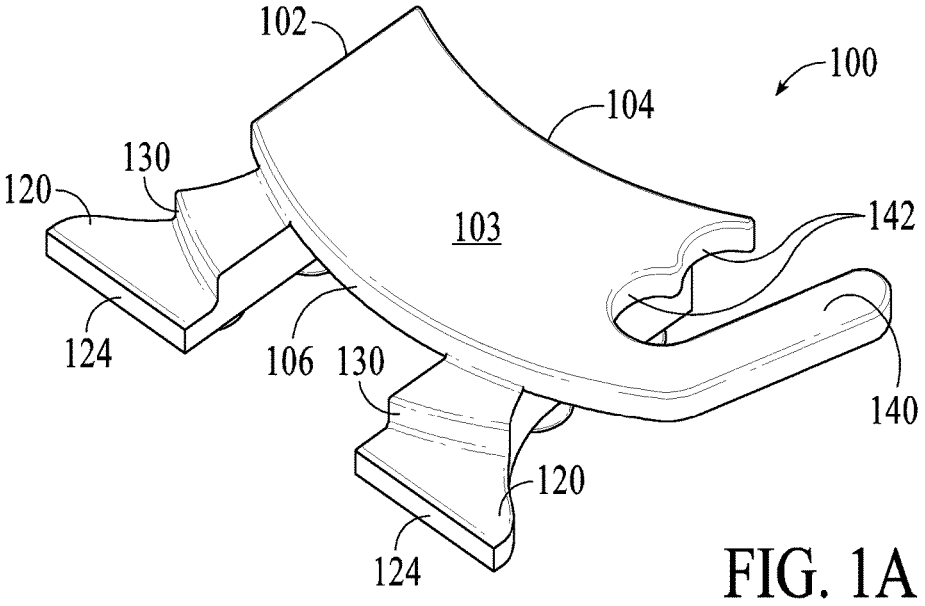
FIG. 1A is an upper, rear view of an embodiment of the pick and strum guide bar 100 of the present invention adapted particularly for use on an acoustic guitar.
Figure 1B:
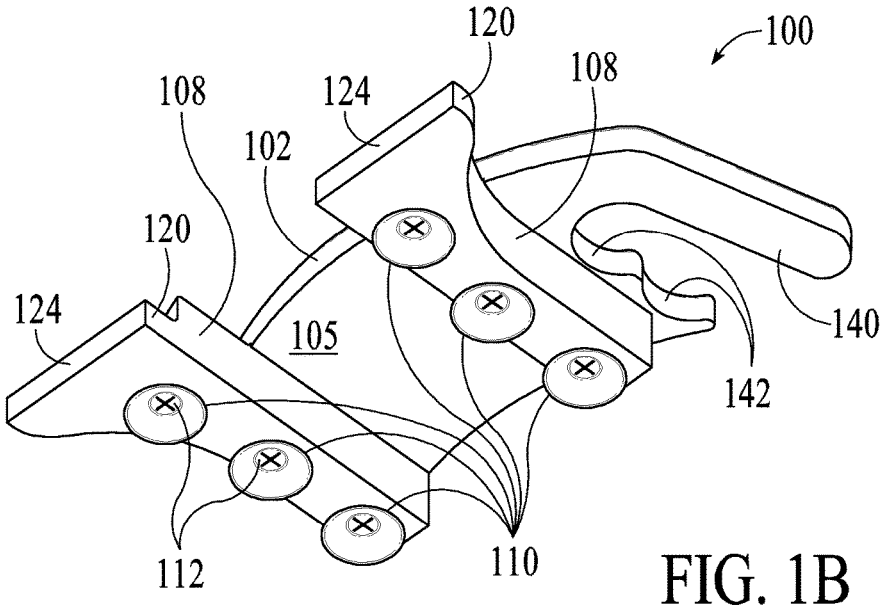
FIG. 1B is a lower, rear view of the pick and strum guide bar 100 shown in FIG. 1A.

FIG. 1A is an upper, rear view of an embodiment of the pick and strum guide bar 100 of the present invention adapted particularly for use on an acoustic guitar. FIG. 1B is a lower, rear view of the pick and strum guide bar 100 shown in FIG. 1A. In this embodiment, the platform portion 102 is slightly curved on both the leading edge 104 and the rear edge 106 to correspond with the curvature of the sound hole on an acoustic guitar (not shown). The platform portion 102 is raised above the strings with two support legs 108. The upper surface 103 of the platform portion 102 is smooth or textured, as desired. Gripping suction cups 110 that grip the top of the sound board of the guitar (not shown) are attached to the support legs 108 with small screws 112, adhesive or other attaching means.

At the rear edge 106 of the pick and strum guide bar 100, leg ends 120 extend from the legs 108 to adjacent the bridge of the guitar. In addition, flat ends 124 align the guide bar 100 flush with the bridge and centered adjacent the sound hole over the strings of the guitar (not shown). The leg ends 120 have a stepped portion 130 which decreases the thickness of the leg portions 120 and thus decrease weight and profile of the guide bar 100 of the present invention.

At one side of the guide bar 100, extending dogleg portion 140 and inner grooves 142 provide an ergonomic stabilization of the player's hand (not shown) while picking or strumming the guitar (not shown).

Figure 2A:
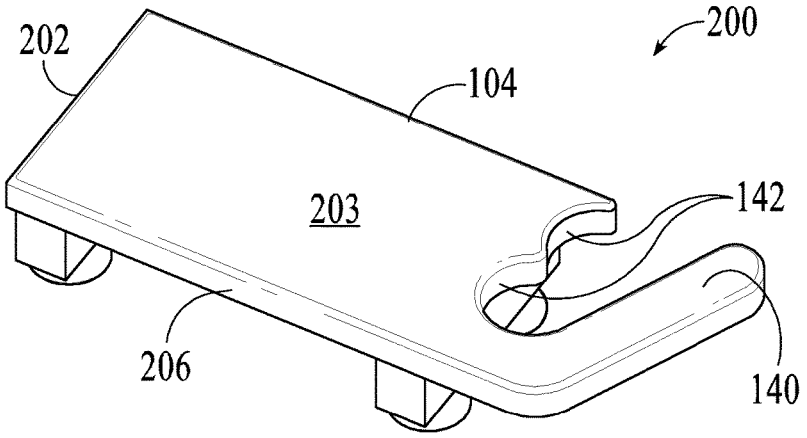
FIG. 2A is an upper, rear view of an embodiment of the pick and strum guide bar 200 of the present invention adapted particularly for use on an electric guitar.
Figure 2B:
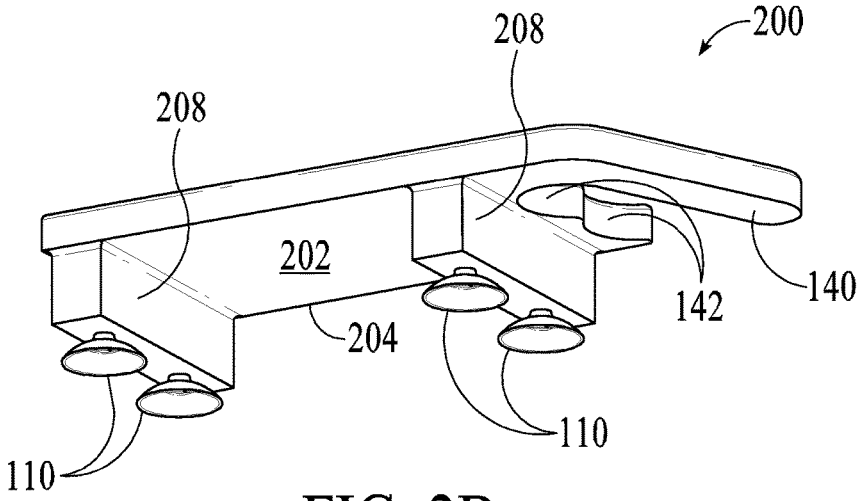
FIG. 2B is a lower, rear view of the pick and strum guide bar 200 shown in FIG. 2A.

FIG. 2A is an upper, rear view of an embodiment of the pick and strum guide bar 200 of the present invention adapted particularly for use on an electric guitar. FIG. 2B is a lower, rear view of the pick and strum guide bar 200 shown in FIG. 2A. In this embodiment, the platform portion 202 is flat on both the leading edge 204 and the rear edge 206. The platform portion 202 is raised above the strings with two support legs 208. The upper surface 203 of the platform portion 202 is smooth or textured, as desired. Gripping suction cups 110 that grip the top of the electric guitar (not shown) are attached to the support legs 208 with small screws, adhesive or other attaching means. At one side of the guide bar 200, extending dogleg portion 140 and inner grooves 142 provide an ergonomic stabilization of the player's hand (not shown) while picking or strumming the guitar (not shown). The compact design of the guide bar 200 is made to fit between electrical pickups mounted on the body of the electric guitar.

Figure 3A:
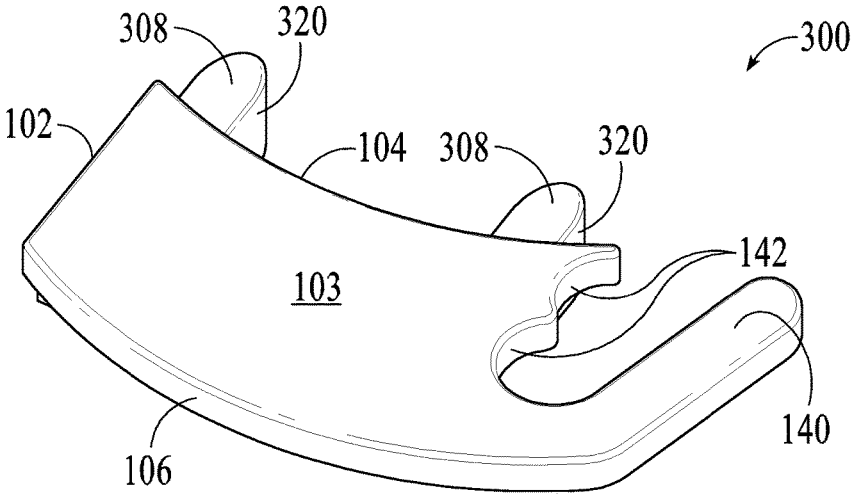
FIG. 3A is an upper, rear view of another embodiment of the pick and strum guide bar 300 of the present invention adapted particularly for use on an acoustic guitar.
Figure 3B:
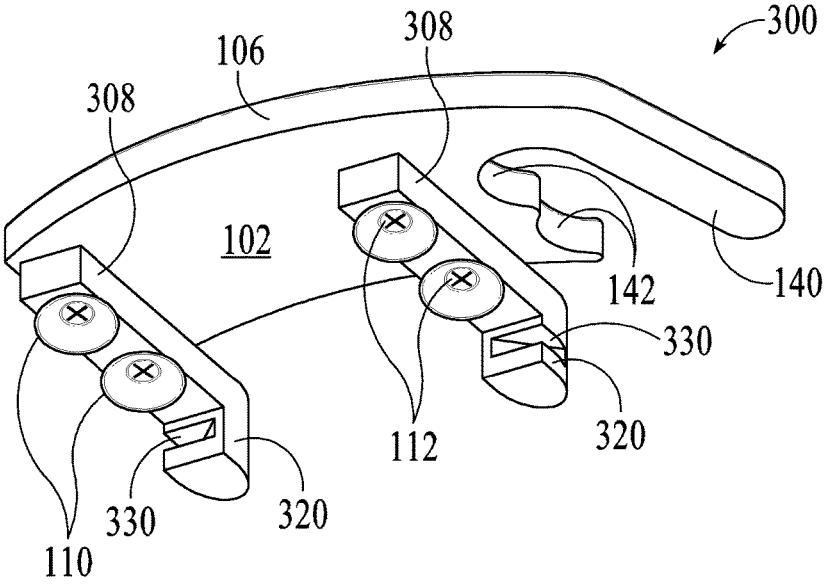
FIG. 3B is a lower, rear view of the pick and strum guide bar 300 shown in FIG. 3A.

FIG. 3A is an upper, rear view of another embodiment of the pick and strum guide bar 300 of the present invention adapted particularly for use on an acoustic guitar. FIG. 3B is a lower, rear view of the pick and strum guide bar 300 shown in FIG. 3A. In this embodiment, the platform portion 102 is slightly curved on both the leading edge 104 and the rear edge 106 to correspond with the curvature of the sound hole on an acoustic guitar (not shown). The platform portion 102 is raised above the strings with two support legs 308. The upper surface 103 of the platform portion 102 is smooth or textured, as desired. Gripping suction cups 110 that grip the top of the sound board of the guitar (not shown) are attached to the support legs 308 with small screws 112, adhesive or other attaching means.

At the side of the rear edge 106 of the pick and strum guide bar 300, extensions 320 extend forward from the legs 308. In addition, leg ends 320 pass through the sound hole in the top sound board of the guitar (not shown). Grooves 330 are cut into the leg ends 320 on one side only at an angle such as at an angle of 45° or more or less. Thus, when the leg ends 320 are placed through the sound hole of the guitar and the guide bar 300 is shifted toward the bottom end of the guitar, the grooves 330 engage with the sound board so the player can accurately align the guide bar 300 centered adjacent the sound hole over the strings of the guitar (not shown). As in the prior embodiments, one side of the guide bar 300 comprises extending dogleg portion 140 and inner grooves 142 that provide an ergonomic stabilization of the player's hand (not shown) while picking or strumming the guitar (not shown).

Figure 4A:
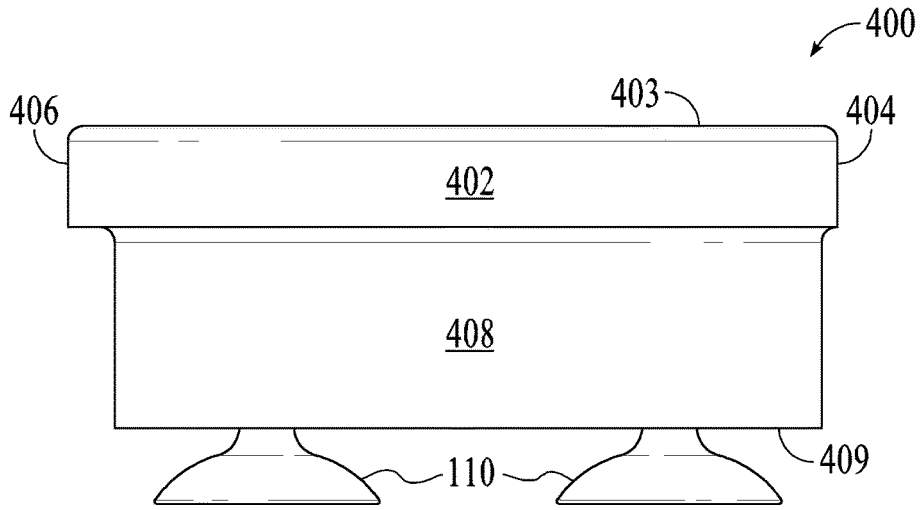
FIG. 4A is side view of an embodiment of the pick and strum guide bar 400 of the present invention.
Figure 4B:
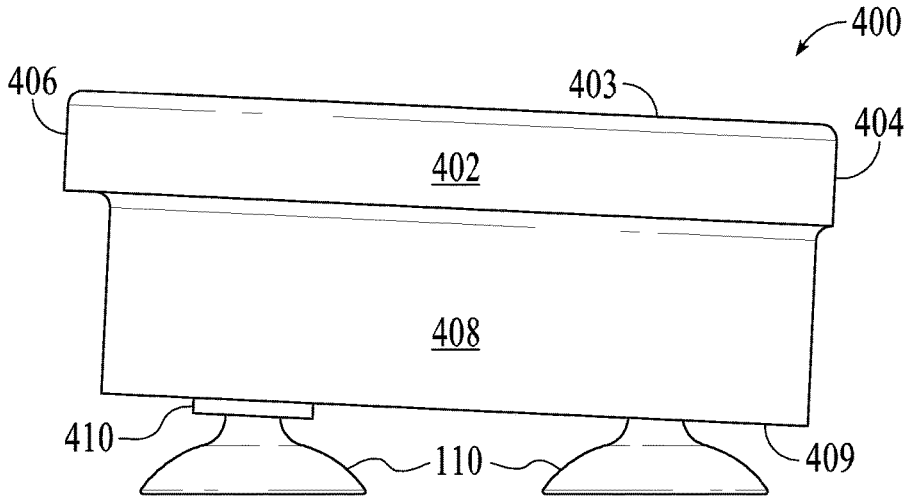
FIG. 4B is side view of another embodiment of the pick and strum guide bar 400 of the present invention.

FIG. 4A is side view of an embodiment of the pick and strum guide bar 400 of the present invention. FIG. 4B is side view of another embodiment of the pick and strum guide bar 400 of the present invention. Upper platform portion 402 has both a leading edge 404 and a trailing edge 406. The upper surface 403 of the platform portion 402 is smooth or textured, as desired. Suction cups 110 or other attachment means are attached to the bottoms 409 of the supporting legs 408.

In general, if the top of the soundboard of the guitar is relatively flat, the configuration shown in FIG. 4A will work fine. However, in certain instances, the top of the soundboard is arched or curved, and thus the bottom surface 105 (as best shown in FIG. 1B) of the platform portion 102 may bear down and inadvertently touch the strings. In this situation, adding spacers 410 will increase the height of the platform portion 102 above the strings for increased, appropriate clearance between the lower surface 105 of the platform portion 102 and the strings. It will be understood that one or more spacers 410 can be stacked to increase the clearance or effective height of the legs portions 108 and 408.

Figure 5A:
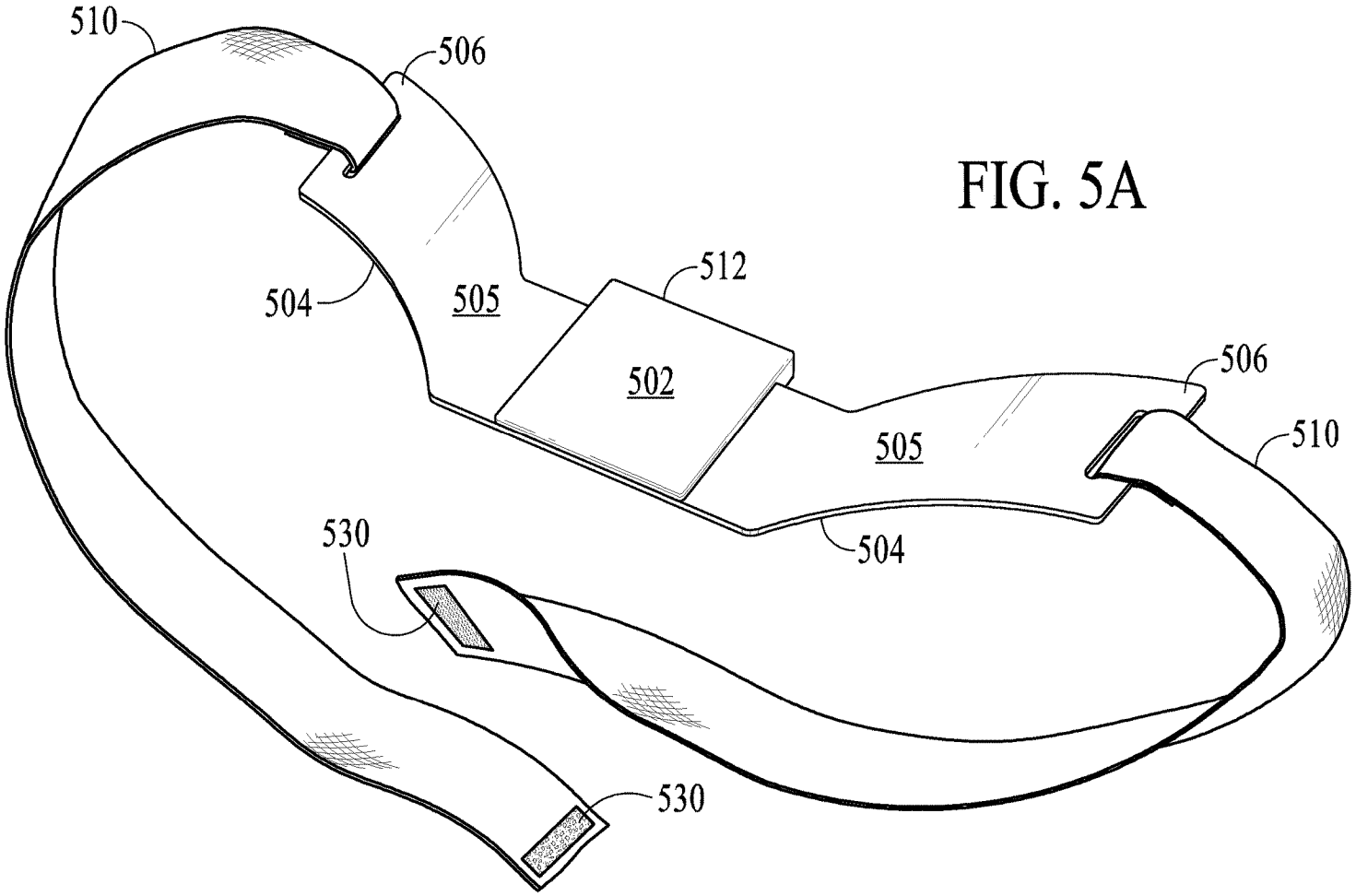
FIG. 5A is an upper orthogonal view of an embodiment of an auxiliary mounting accessory 500 for the pick and strum guide bar of the present invention.
Figure 5B:
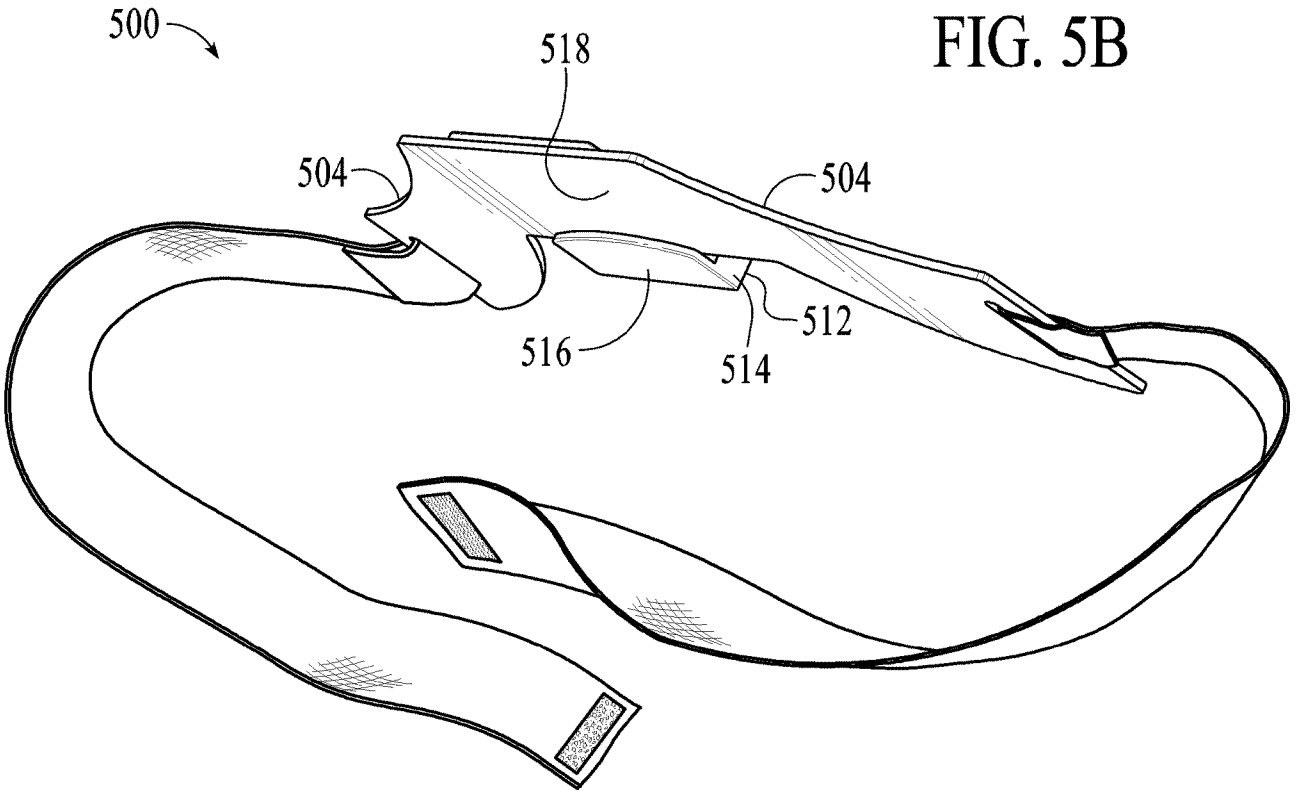
FIG. 5B is a lower orthogonal view of the auxiliary mounting accessory 500 shown in FIG. 5A.

FIG. 5A is an upper orthogonal view of an embodiment of an auxiliary mounting accessory 500 for the pick and strum guide bar 400 of the present invention. FIG. 5B is a lower orthogonal view of the auxiliary mounting accessory 500 shown in FIG. 5A. It will be understood that in order for the acoustic guitar guide bar 100 and the electric guitar guide bar 200 and other embodiments of the guide bar shown herein to be attached removably to the top surface of the sound board of a guitar with a series of suction cups 110 coupled to the legs portions 108 and 208, respectively, the top surface of the guitar must be relatively smooth. Unfortunately, in many instances, the top surface of a guitar might not be a sooth, flat varnished surface and instead be unfinished, non-flat, textured, painted or other surface that a suction cup 110 will not stick to or will not stick to properly. In this case, it is desirable to use an auxiliary mounting device 500 to fit underneath the strings between the guitar and the guide bar 100.

A center section 502 has opposing, angled flat arms 504. The arms 504 can be straight and angled or curved. The result is the elastic or inelastic strap portions 510 that couple to the distal ends 506 of the arms 504 can be wrapped around either of the incurved sides of the guitar (not shown) leaving the center section 502 positioned between the sound hole and the bridge of the guitar. Thus, the center section 502 of the auxiliary mounting accessory 500 does not cover any portion of the sound hole.

The leading edge 512 of the auxiliary mounting accessory 500 has a foot portion 514 has a flange 516 that extends a short distance underneath the center section 502. When the auxiliary mounting device 500 is installed, the mounting accessory is slipped between the strings and the top of the soundboard and the flange 516 is placed inside the sound hole of the guitar and shifted backward. Thus, \the foot 512 of the center section 502 is positioned flush with and in contact with the periphery of the sound hole with the flange 516 and the lower surface 518 of the center section 502 securing the auxiliary mounting device 500 inside the peripheral edge of the sound hole.

Figure 5C:
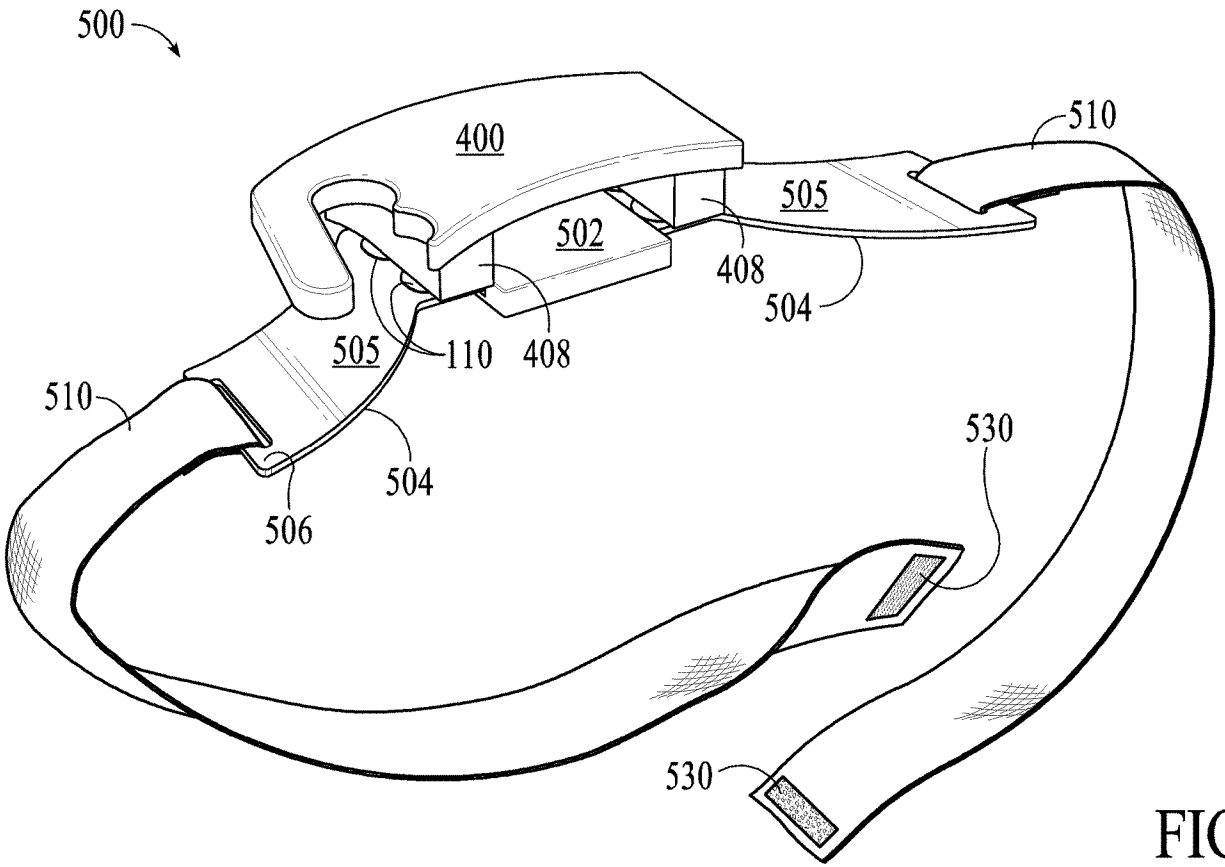
FIG. 5C is an upper orthogonal view of the auxiliary mounting accessory 500 shown in FIG. A with an embodiment of the pick and strum bar 400 of the present invention mounted thereon.

FIG. 5C is an upper orthogonal view of the auxiliary mounting accessory 500 shown in FIG. A with an embodiment of the pick and strum bar 400 of the present invention mounted thereon. It will be understood that once the auxiliary mounting device 500 is secured in place with the flange 516 placed along the peripheral edge of the sound hole and the mounting straps 510 coupled together with Velcro-brand hook and loop material 530 or other attachment means including but not limited to hooks and eyes, snaps, buttons, etc. The suction cup connectors 110 firmly grip the smooth upper surface 505 of the side arms 504

Figure 6A:
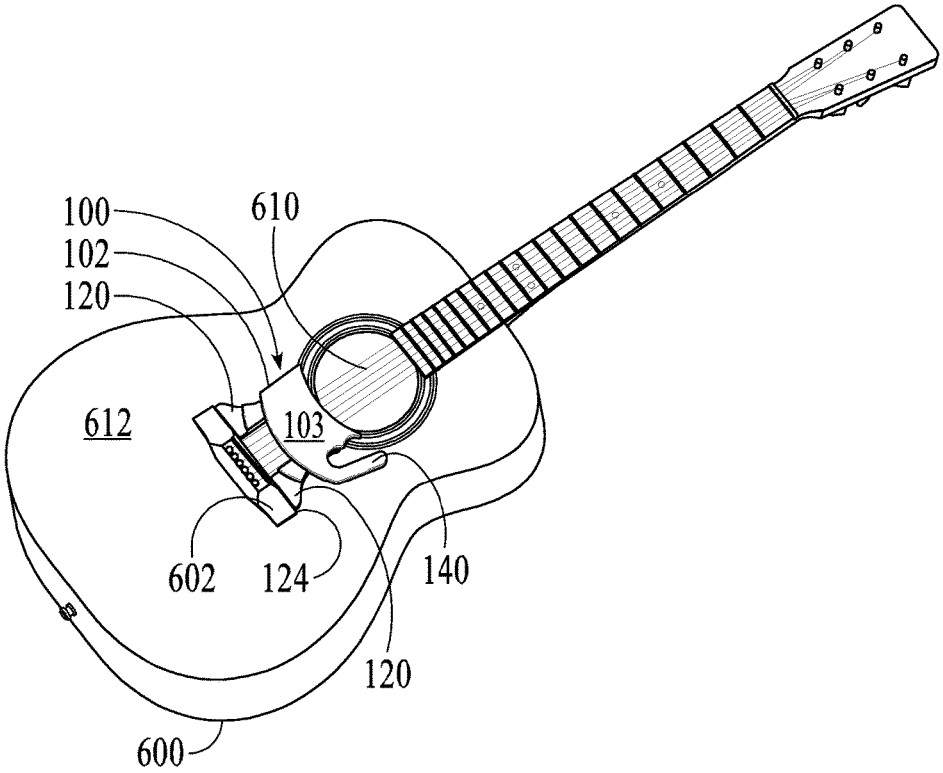
FIG. 6A is an upper orthogonal view of an acoustic guitar 600 with the pick and strum bar 100 shown in FIGS. 1A and 1B mounted thereon.

FIG. 6A is an upper orthogonal view of an acoustic guitar 600 with the pick and strum bar 100 shown in FIGS. 1A and 1B mounted thereon. As described above, the base portions 124 of the leg ends 120 of the strum bar 100 abut the bridge 602 of the acoustic guitar 600 and straddle the strings 610. The upper platform 102 is above the strings 610. Suction cups 110 attach to the top surface 612 of the acoustic guitar 600, and along with the leg ends 120 of the strum bar 100 abutting the bridge 602 of the acoustic guitar 600, prevent the strum bar 100 from shifting or sliding across the top 612 of the guitar when the acoustic guitar 600 is being played.

Figure 6B:
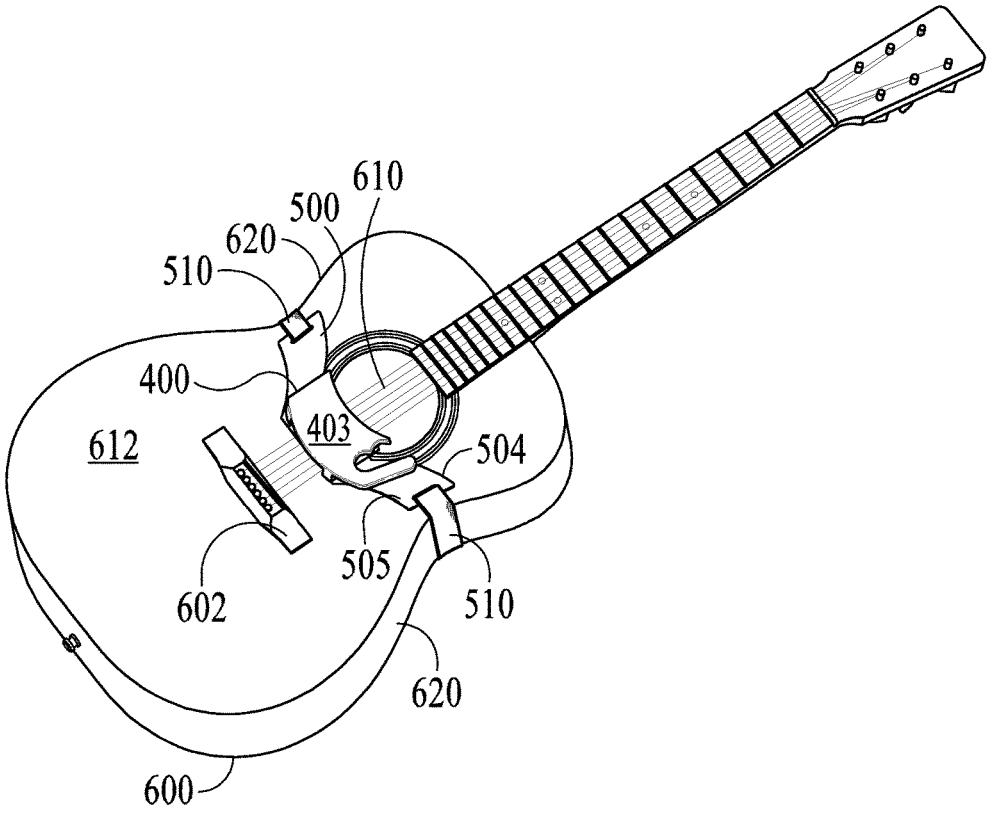
FIG. 6B is an upper orthogonal view of an acoustic guitar 600 with the auxiliary mounting accessory 500 shown in FIGS. 5A-5B and a pick and strum bar 400 of the present invention mounted thereon.

FIG. 6B is an upper orthogonal view of an acoustic guitar 600 with the auxiliary mounting accessory 500 shown in FIGS. 5A-5B and a pick and strum bar 400 of the present invention mounted thereon. The straps 510 of the accessory 500 encircle the acoustic guitar 600 at the incurved sides 620 and couple behind the guitar (not shown). The suction cup connections 110 firmly attach the strum bar 400 to the upper surfaces 505 of the side arms 504.

Figure 6C:
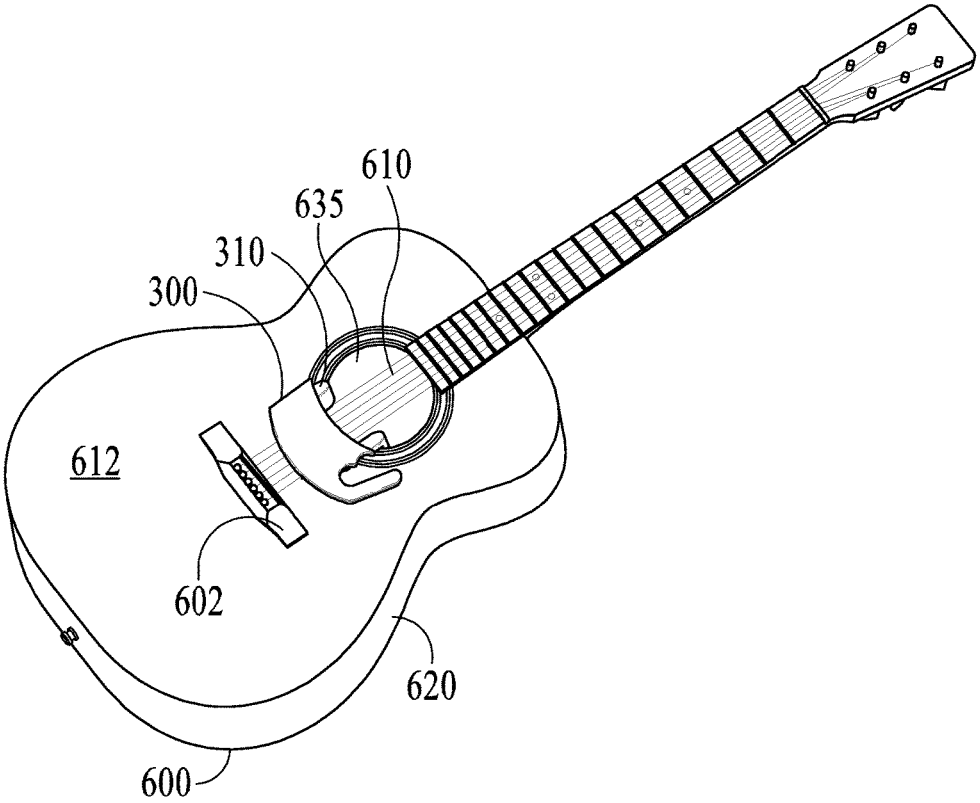
FIG. 6C is an upper orthogonal view of an acoustic guitar 600 with the pick and strum bar 300 shown in FIGS. 3A and 3B mounted thereon.

FIG. 6C is an upper orthogonal view of an acoustic guitar 600 with the pick and strum bar 300 shown in FIGS. 3A and 3B mounted thereon. As described above, the forward extensions 320 from legs portions 308 drop through the sound hole 630 and when shifted toward the bridge 602 of the acoustic guitar 600 the integral grooves 330 clip onto the edge 635 of the sound hole 630. In combination with the suction cups 110 that attach to the top surface 612 of the acoustic guitar 600, the grooves 330 clipped onto the edge 635 of the sound hole 630 keep the strum bar 300 from shifting or sliding on the top 612 of the acoustic guitar 600 when the acoustic guitar 600 is being played.

Figure 6D:
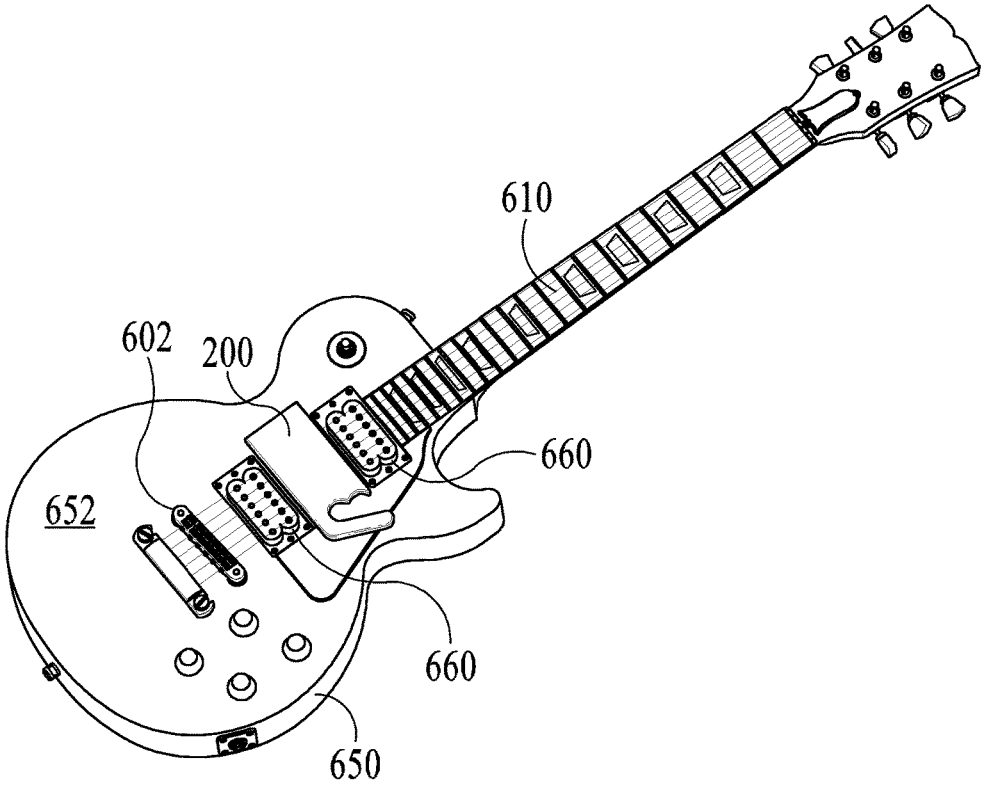
FIG. 6D is an upper orthogonal view of an electric guitar 650 with the pick and strum bar 200 shown in FIGS. 2A and 2B mounted thereon.

FIG. 6D is an upper orthogonal view of an electric guitar 650 with the pick and strum bar 200 shown in FIGS. 2A and 2B mounted thereon. As described above, the legs 208 of the strum bar 200 straddle the strings 610 of the electric guitar 650 and straddle the strings 610. The upper platform 202 is above the strings 610. Suction cups 110 attach to the top surface 652 of the electric guitar 650, and prevent the strum bar 200 from shifting or sliding across the top 652 of the electric guitar 650 when the electric guitar 650 is being played. In addition, the rectangular shape of the upper platform 202 and compact design of the guide bar 200 makes it easy to align and center the guide bar 200 adjacent the bridge 602 and/or one or more electronic pickups 660.

Figure 7:
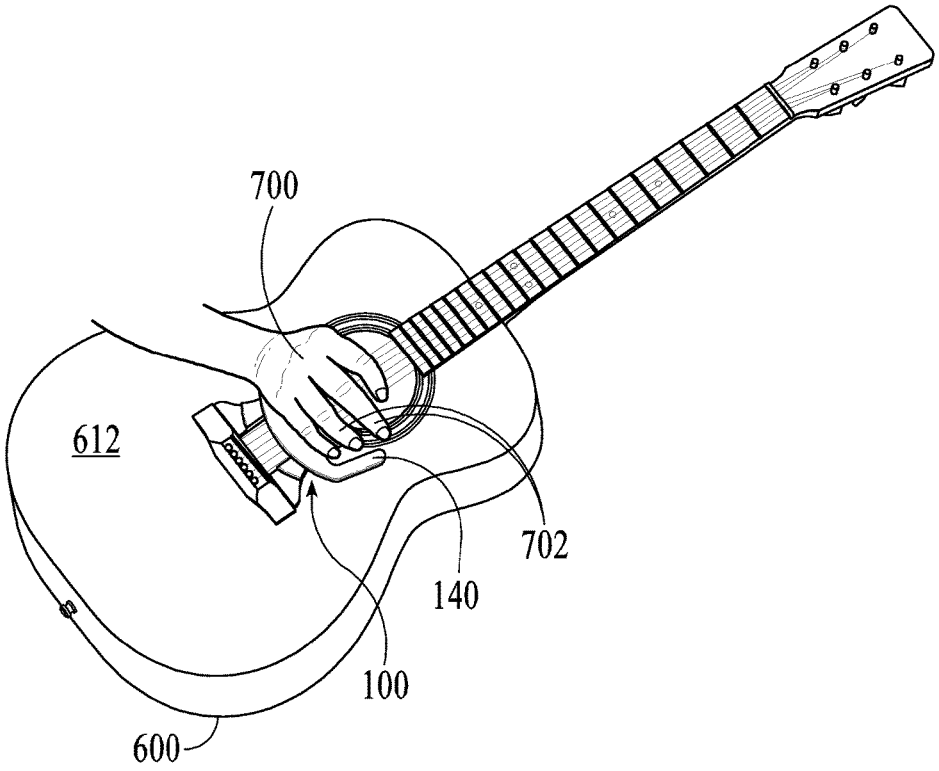
FIG. 7 is an upper orthogonal view of a method of use of an acoustic guitar 600 with the pick and strum bar 100 shown in FIGS. 1A and 1B mounted thereon.

FIG. 7 is an upper orthogonal view of a method of use of an acoustic guitar 600 with the pick and strum bar 100 shown in FIGS. 1A and 1B mounted thereon. As described above, the hand 700 of the guitar player can rest with the palm of the hand (not shown) in contact with the upper surface 103 of the top platform 102. This permits the player to accurately place the hand 700 used to pick and/or strum the guitar 600 in the same place each time the player uses the guitar 600.

Optionally, the player can extend or slip either one or two fingers 702 into the ergonomic finger grips 142. The player can either brace the fingers 702 inside the grooved finger grips 142 on the top platform portion 102 or extend the fingers 702 all the way through to the top surface 612 of the acoustic guitar 600. The dogleg portion 140 of the top platform 102 provides the player with a place for a consistent placement of the pick and strum hand 700 and fingers 702 while playing the guitar 600.

Location. Static. Arm and Hand Locating. Use of the guide bar 100 of the present invention will provide the hand and arm a place and means to center the extremity at the exact same point at which the hand/arm can do it's best work.

Arm and Hand Stabilizing. The present invention allows the properly placed extremity to be set and remain so while doing work.

Thumb and Fingers Pre-Dynamic Placement. Position/Reposition Dynamic. The thumb and index and middle finger work to make the music.

The First Position is resting the pinky or little finger 702 in the first finger cut-out grip 142, thus allowing the rest of the hand 700 to work either a pick or the thumb and/or index finger and ring finger and middle finger. The Second Position is resting the ring and little fingers 702 in both cut-outs 142. This position has mixed qualities: Greatest stability to work the other fingers and thumb and greater limitation with two fingers locked up.

Open access to dual cut-outs 142, the fingers can be quickly freed for a more free and easy play: Break-Out, the hand 700 exits the set points of the cut-outs 142 for free and open play; Break-In moving the hand into the confines of the cut-outs 142 for greatest stability for small string play, or multi-string chord play.

Repetitive exact play produces a strong muscle-memory of precise placement of fingers and thumb for the exact notes. Extensive use of the bar 100 may render the player more capable of playing without it, but also allows the use of the bar 100 when it is desired or preferable.

Palm-muting is possible using the bar 100. Using the right hand to mute the sound just made. To accomplish this with the guide bar 100, the player just mutes the strings 610 above the platform portion 102.

While the use of either a pick or fingers 702 to make sound with force, precision and speed, it is the guide bar 100 that provides the exact placement to allow the sound in two dimensions: Across the six string 610 up and down, or deep or shallow into the strings 610.

The steps or phases to play guitar can be summarized as follows: 1. Ready—move the arm and hand 700 to an exact place to begin play—palm on the flat upper surface 103 of the bar 100, and finger(s) 702 into the 1 or 2 finger cut-outs 142. 2. Set—move the arm and hand situated in the best position to play, visualizing or deciding on the next step. Then, 3. Go—begin to play, moving the arm and hand and fingers playing (a) picking notes, and (b) strumming chords. It will be understood that the three steps can all occur very quickly, such in 1 second or less.

Pick or strum play is possible. The thumb can be used to great effect with both the up and down picking of separate strings or brushing several strings for a pleasant chord effect. The former technique is called the"Thenar Eminance Thumb Stroke", the latter the "Thenar Eminance Slide Technique."

Figure 8A:
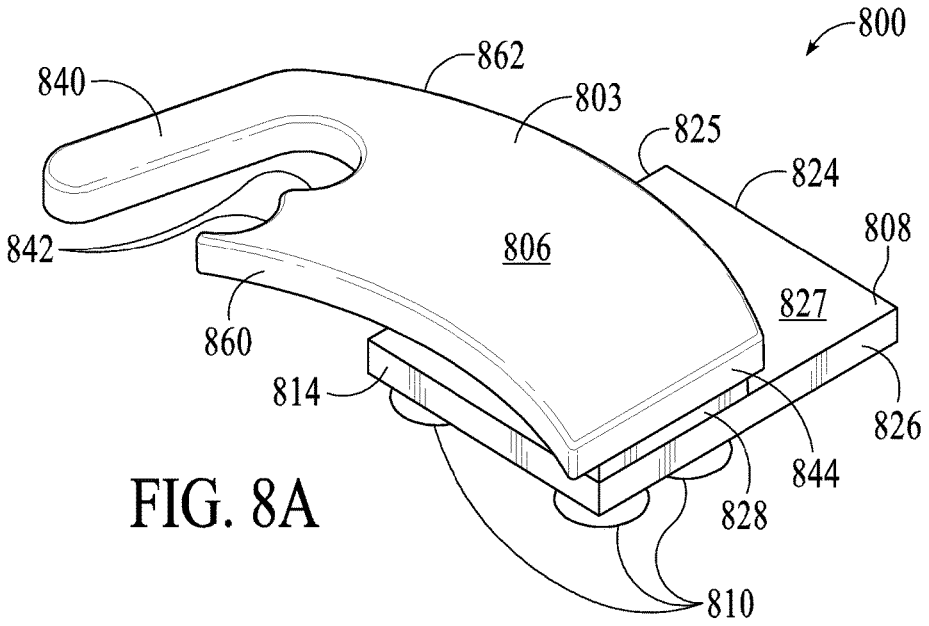
FIG. 8A is an upper, front view of an embodiment of the pick and strum guide bar 800 of the present invention.
Figure 8B:
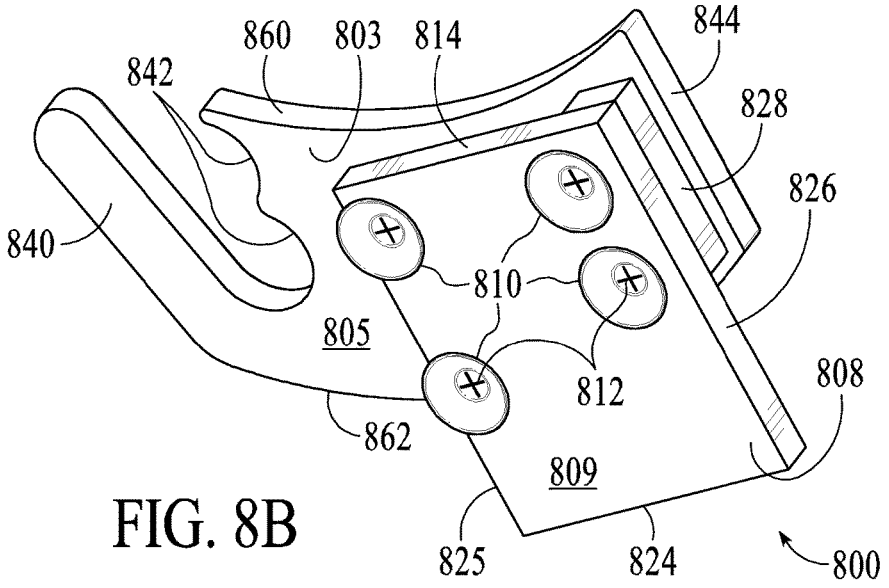
FIG. 8B is a lower, front view of the pick and strum guide bar 800 shown in FIG. 8A.
Figure 8C:
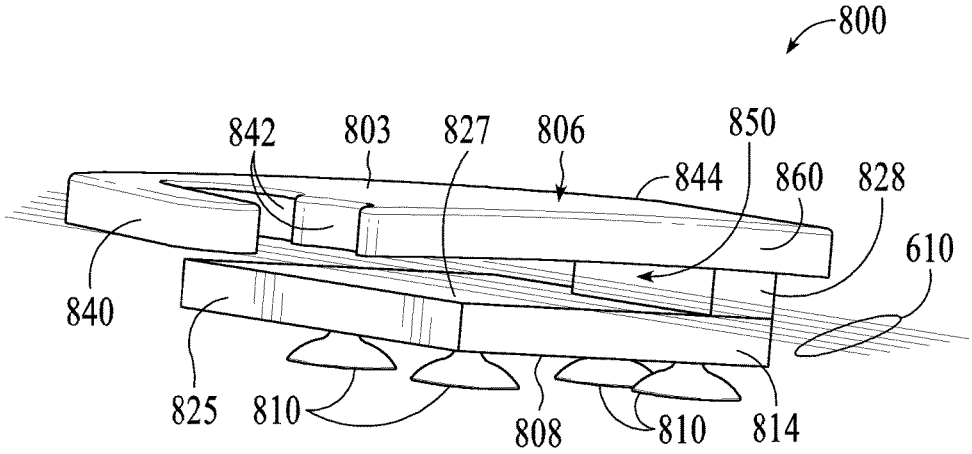
FIG. 8C is an upper, front view of the pick and strum guide bar 800 shown in FIG. 8A.
Figure 8D:
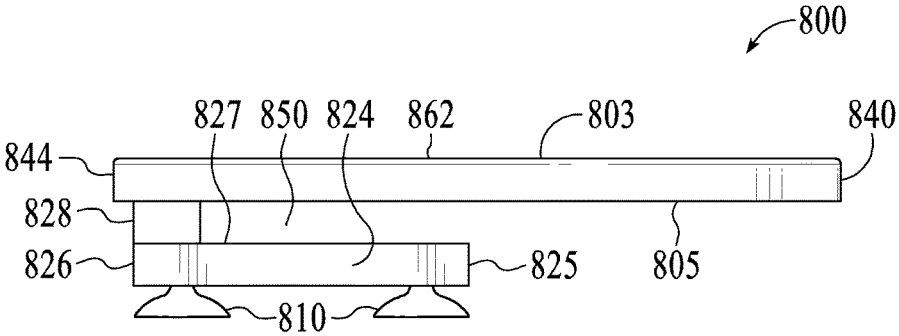
FIG. 8D is a rear side view of the pick and strum guide bar 800 shown in FIG. 8A.

FIG. 8A is an upper, front view of an embodiment of the pick and strum guide bar 800 of the present invention. FIG. 8B is a lower, front view of the pick and strum guide bar 800 shown in FIG. 8A. FIG. 8C is an upper, front view of the pick and strum guide bar 800 shown in FIG. 8A. FIG. 8D is a rear side view of the pick and strum guide bar 800 shown in FIG. 8A.

The pick and strum guide bar 800 of the present invention is comprised essentially of 3 interconnected structural members, i.e., a base portion 808, a pedestal 828 and an upper platform portion 803, and a plurality of attaching means 810.

The base portion 808 has a leading edge 814, a rear edge 824, a left side edge 825 and a right side edge 826. The plurality of attaching means 810 are attached to the base portion 808 of the pick and strum guide bar 800 of the present invention with small screws, nails, spikes, etc. 812, and optionally set in place with an adhesive, epoxy, weld, etc. It will be understood that coupled to the lower surface 809 of the base portion 808, the attaching means 810 can be a number of individual suction cups, magnetic coupling members, or other means for temporarily and/or removably attaching the pick and strum guide bar 800 of the present invention onto the upper surface 612 of a guitar 600.

The base portion 808 of the pick and strum guide bar 800 of the present invention can be varied in length to accommodate use of the pick and strum guide bar 800 with acoustic or electric guitars. It will be understood that the distance between the bridge 612 and the sound hole 630 on different guitars may vary. Therefore, the lengths of the left side edge 825 and the right side edge 826 can be shorter or longer. Depending upon the desired distance between the leading edge 814 and the rear edge 824.

The pedestal portion 828 of the pick and strum guide bar 800 of the present invention couples the base portion 808 to the upper platform portion 803. It will be understood that the pedestal portion 828 is adjacent the right side 826 of the base portion 808, and is coupled to the lower surface 805 of the platform portion 803. Thus, a narrow gap 850 is defined by the upper surface 827 of the base portion 808, the pedestal portion 828 and the lower surface 805 of the platform portion 803.

Finally, the platform portion 803 of the pick and strum guide bar 800 of the present invention has, in addition to the lower surface 805, an upper surface 806, a leading edge 860 and a rear edge 862. As in other embodiments described herein, the pick and strum guide bar 800 of the present invention has a dogleg portion 840 and inner grooves 842 that provide an ergonomic stabilization of the player's hand while picking or strumming the guitar. Across the upper platform 803 opposite the dog leg portion 840, the right edge 844 extends adjacent the pedestal portion 828.

Figure 9:
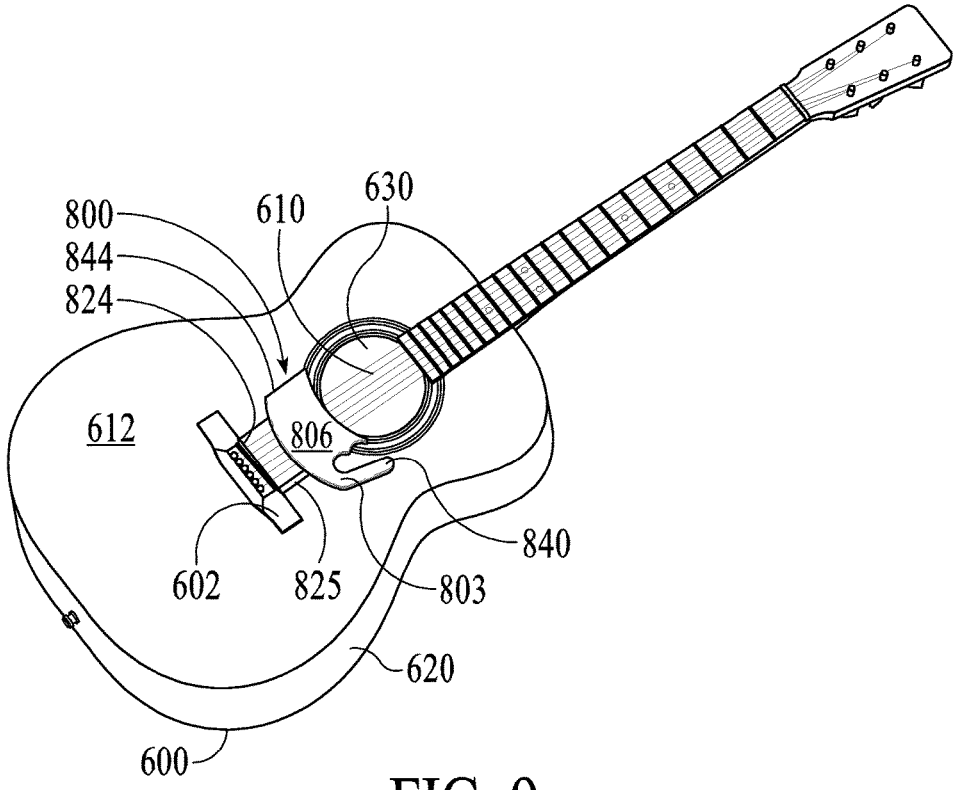
FIG. 9 is a representative view of a method of use of the pick and strum guide bar 800 shown in FIG. 8A.

FIG. 9 is a representative view of a method of use of the pick and strum guide bar 800 shown in FIG. 8A. To install the pick and strum guide bar 800 of the present invention on a guitar 600, the left side edge 825 is inserted between the strings 610 of the guitar 600 and the upper surface 612 of the guitar 600, midway between the bridge 602 and the sound hole 630. The pick and strum guide bar 800 is preferably positioned with the suction cup attachment means 810 positioned essentially underneath the strings 610.

Alignment of the pick and strum guide bar 800 of the present invention is relatively easy. The rear edge 824 can be placed adjacent to, in contact with and/or lined up flush with the bridge 612 of the guitar 600. In addition, the pedestal portion 828 can be lined up flush adjacent or underneath the high E-string and/or the right side edge portion 826 can be lined up flush adjacent or underneath the low E-string. Thus, the user will find it easy to position accurately and in the same location consistently. Once the pick and strum guide bar 800 is positioned in the location where desired, the suction cup attachment means 810 can be pressed down onto the upper surface 612 of the guitar 600 to provide a reliable, secure, removable and temporary bond between the pick and strum guide bar 800 and a guitar 600.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A hand placement guide and support device for placement adjacent the bridge of the guitar for use playing a guitar by picking or strumming the strings, the device comprising:

A base portion having an upper surface that fits between the strings of a guitar and the body of the guitar adjacent the guitar bridge, the base portion having means for removably attaching the base portion to the upper surface of the body of a guitar;

A pedestal portion attached to the base portion; and

A platform portion having a lower surface attached to the pedestal portion such that the platform portion is cantilevered over the strings of the guitar, the upper surface of the base portion, the pedestal portion and the lower surface of the platform portion defining a narrow gap, whereby the attachment means secures the device to the guitar adjacent the bridge and the platform portion can support the hand of a guitar player picking or strumming the strings adjacent the bridge of the guitar.

2. A hand placement guide and support device that can be temporarily and removably located on the upper surface of the body of a guitar so that hand and fingers of the guitar player are accurately positioned for picking and/or strumming the guitar, the hand placement guide and support device comprising:

a base portion with a left side edge that fits between the strings of a guitar and the upper surface of a guitar adjacent the bridge of a guitar, the base portion having a lower surface and an upper surface, the base portion further comprising one or more attachment mechanisms attached to the lower surface of the base portion, each of the one or more attachment mechanisms capable of being temporarily and removably coupled to an upper surface of a body of a guitar to prevent movement of the hand placement guide and support device;

a pedestal portion disposed adjacent the left side edge of the base portion, the pedestal portion permanently fixed to the upper surface of the base portion; and an upper platform portion having an upper surface, a lower surface, a leading side edge, a rear side edge, a left side edge and a right side edge, the upper platform permanently fixed to the pedestal portion such that the pedestal portion is adjacent the right side edge of the upper platform and the upper platform is cantilevered over the base portion, the upper surface of the base portion and the pedestal portion and the lower surface of the upper platform combining to form a narrow gap between the base portion and the upper platform, whereby the left side edge of the base portion fits between strings of a guitar and an upper surface of a guitar, adjacent a bridge of a guitar, and the attachment means attach temporarily and removably to an upper surface of a guitar such that the upper platform portion is cantilevered from the pedestal portion over strings of a guitar.

3. The hand placement guide and support device of claim 2 wherein the one or more attachment mechanisms are suction cups.

4. The hand placement guide and support device of claim 2 wherein the one or more attachment mechanisms are temporary adhesive materials.

5. The hand placement guide and support device of claim 2 further comprising a narrow, dogleg extension portion contiguous with and extending adjacent the left side edge of the upper platform portion.

6. The hand placement guide and support device of claim 2 further comprising one or more ergonomic finger grip portions positioned along the left side edge of the upper platform portion.

7. The hand placement guide and support device of claim 2 further comprising:

a narrow, dogleg extension portion contiguous with and extending adjacent the left side edge of the upper platform portion; and one or more ergonomic finger grip portions positioned adjacent the left side edge of the upper platform portion, wherein the dogleg extension portion is adjacent the one or more ergonomic finger grip portions.

8. The hand placement guide and support device of claim 2 in which the leading edge of the upper platform portion has a curvature that matches a curvature of a sound hole of a guitar, whereby the hand placement guide and support device can be aligned adjacent the sound hole of a guitar without interfering with the passage of sound there through.

9. The hand placement guide and support device of claim 2 in which the length of the base portion matches a distance between a bridge of a guitar and a location on strings of a guitar where the strings are picked or strummed.

* * * * *